US005476079A

United States Patent [19]

Kanamori et al.

[11] Patent Number: 5,476,079

[45] Date of Patent: Dec. 19, 1995

[54] ELECTROMAGNETIC VALVE FOR OPENING OR CLOSING FLUID PASSAGE

[75] Inventors: Hiroyasu Kanamori; Takio Tani, both of Chiryu, Japan

[73] Assignee: Nippondenso Co., Ltd., Japan

[21] Appl. No.: 341,224

[22] Filed: Dec. 2, 1994

[30] Foreign Application Priority Data

Dec. 3, 1993 [JP] Japan ..... 5-304147

[51] Int. Cl.[6] ..... F02M 41/00

[52] U.S. Cl. ..... 123/458; 251/129.16; 335/279; 335/263

[58] Field of Search ..... 123/458, 506; 251/129.16; 335/279, 261, 262, 263

[56] References Cited

U.S. PATENT DOCUMENTS

| | | | |
|---|---|---|---|
| 3,281,741 | 10/1966 | Beliueau | 335/261 |
| 3,842,809 | 10/1974 | Kiwc | 123/458 |
| 4,653,455 | 3/1987 | Eblen et al. . | |
| 4,690,373 | 9/1987 | Linder | 251/129.16 |
| 4,690,374 | 9/1987 | Polach | 251/129.16 |
| 4,750,514 | 6/1988 | Omori | 251/129.16 |
| 4,753,212 | 6/1988 | Miyashi | 123/458 |
| 4,832,312 | 5/1989 | Linder | 123/458 |
| 5,239,968 | 8/1993 | Rodriguez-Amaya et al. . | |
| 5,244,180 | 9/1993 | Wakeman | 251/129.16 |
| 5,277,163 | 1/1994 | Ohishi | 123/458 |
| 5,315,278 | 5/1994 | Demere | 235/279 |
| 5,347,970 | 9/1994 | Pape | 123/458 |

FOREIGN PATENT DOCUMENTS

| | | |
|---|---|---|
| 480876 | 4/1992 | European Pat. Off. . |
| 61-72867 | 4/1986 | Japan . |
| 4282087 | 10/1992 | Japan . |
| 5256227 | 10/1993 | Japan . |

*Primary Examiner*—Carl S. Miller
*Attorney, Agent, or Firm*—Cushman Darby & Cushman

[57] ABSTRACT

An electromagnetic valve opens and closes a fuel return passage (23, 24) of a fuel injection pump, to control a time of fuel return when fuel compressed by a plunger (12) of the fuel injection pump is overflowed from a high-pressure fuel chamber (19) to a low-pressure fuel chamber (11). A valve needle (36) causes a reciprocative movement in an axial direction thereof to open or close the fuel return passage (23, 24). A terminal (46), supplying electric current to the electromagnetic valve, is disposed along the axial direction of the valve needle (36). A plate-like armature (43), connected to one end of the valve needle (36), has a through hole (43*a*) allowing the terminal (46) to enter therein and causing a reciprocative movement together with the valve needle (36). The outer periphery of the armature (43) extends radially further than the terminal (46). A coil (44), connected to the terminal (46), is disposed in confronting relation to a side surface of the armature (43) located adjacent to the valve needle (36).

19 Claims, 4 Drawing Sheets

ELECTROMAGNETIC VALVE FOR OPENING OR CLOSING FLUID PASSAGE

BACKGROUND OF THE INVENTION

1. Field of the Invention:

The present invention relates to an electromagnetic valve having a valve member slidable in an axial direction thereof and capable of causing a reciprocative movement in response to activation and deactivation of an associated solenoid generating magnetic field.

2. Prior Art:

FIG. 5 shows one example of conventional electromagnetic valves which basically accommodate a plunger type magnetic circuit therein, chiefly used as an electromagnetic valve adjusting an overflow or returning fuel amount of a fuel injection pump for an internal combustion engine. Unexamined Japanese Patent Application No. SHO 61-72867, corresponding to the U.S. Pat. No. 4,653,455, shows another type electromagnetic valve accommodating a plane type magnetic circuit.

In FIG. 5, an electromagnetic valve 100 comprises a casing 101 with one end having a cylindrical bore therein. A valve body 102, communicated with a high-pressure pump chamber (not shown), is fixedly housed in the cylindrical bore of the casing 101. A stationary cylinder 103 has a flange 103*a* fixed to the cylindrical bore of the casing 101. A movable cylinder 104 is slidably supported on the inside wall of the valve body 102. A valve needle 105 is slidably supported on the inside wall of the stationary cylinder 103, and a compression coil spring 106 gives the valve needle 105 a biasing force so as to open the valve. A shim 107 of disk-like shape is interposed between the casing 101 and the stationary cylinder 103 along the axis of the electromagnetic valve 100. The shim 107 regulates the axial movement of the valve needle 105. The casing 101 has the other end having a smaller-diameter bore 101*a* and a larger-diameter bore 101*b* therein. The smaller-diameter bore 101*a* fixedly accommodates a cylindrical bush 110 along its inner wall. The cylindrical bush 110 allows a push rod 111 to slide along the inside wall thereof. The push rod 111 is brought into contact with the valve needle 105 at one end thereof. The other end of the push rod 111 is connected with the armature 112. The armature 112 is slidable along the inside wall of a stator 108, and a compression coil spring 113 gives the armature 112 a biasing force so as to open the valve. A coil 115 wound around a bobbin 114 is housed between the smaller-diameter bore 101*a* and the larger-diameter bore 101*b*. Both ends of the coil 115 are connected to a terminal 116. The terminal 116, entering into a through hole 108*a* formed on the stator 108, supplies electric current from a control circuit (not shown) to the coil 115. The biasing force of the compression coil spring 106 is larger than that of the compression coil spring 113. When the coil 115 is not supplied with electric current, the biasing force of the compression coil spring 106 shifts the valve needle 105 to open the valve.

Until fuel force feeding is finished, the coil 115 receives electric current and generates an electromagnetic attraction force, with which the valve needle 105 is urged to close the valve against the biasing force of the compression coil spring 106. When the fuel force feeding is finished, electric current to the coil 115 is stopped and the biasing force of the compression coil spring 106 acts to return the valve needle 105, thereby opening the valve. Thus, fuel overflows or returns from the high-pressure pump chamber to a low-pressure fuel chamber through an overflow hole 102*a* of the valve body 102 and an overflow or return passage 101*c* formed in the casing 101.

On the other hand, the electromagnetic valve disclosed in the Unexamined Japanese Patent Application No. SHO 61-72867, corresponding to the U.S. Pat. No. 4,653,455, adopts an arrangement in which a coil is extracted outward further than the outermost periphery of an armature and connected to a terminal, thereby preventing the armature from interfering with the terminal when the armature extends radially outward.

However, the electromagnetic valve shown in FIG. 5 is disadvantageous in that the armature 112 is housed radially inside the terminal 116. It means that an area of magnetic flux generated from the coil 115 and passing through the armature 112 is very small. Thus, a magnetic attraction force acting on the armature 112 is not satisfactory. This results in a problem of poor response in the fuel overflow or return characteristics. To improve such poor response, it is normally required to increase electric current to be supplied to the coil 115. However, such an increase of electric current will directly increase electric power consumption.

Moreover, the electromagnetic valve disclosed in the Unexamined Japanese Patent Application No. SHO 61-72867, corresponding to the U.S. Pat. No. 4,653,455, is disadvantageous in that clearance adjustment between the stator and the armature is required at two places, resulting in increase of production cost.

SUMMARY OF THE INVENTION

Accordingly, in view of above-described problems encountered in the prior art, a principal object of the present invention is to provide an electromagnetic valve having excellent response, low electric power consumption and small size.

In order to accomplish this and other related objects, a first aspect of the present invention provides an electromagnetic valve comprising: a valve member causing a reciprocative movement in an axial direction thereof; elastic means for urging the valve member in one direction; a plate-like movable member made of magnetic substance and including a plurality of through holes opened along the axial direction, the movable member being integral with the valve member and causing a reciprocative movement together with the valve member; a solenoid generating magnetic field when activated, to attract the movable member against a biasing force of the elastic means; and a terminal supplying electric current to the solenoid, the terminal being inserted into the through hole of the movable member.

A preferable mode of the above electromagnetic valve defined by the above first aspect of the present invention includes the following features.

An insulating member is provided around the terminal at a region where the movable member causes a reciprocative movement, to insulate the terminal from the movable member. The insulating member is made of ceramic. The number of the through holes formed on the movable member is larger than the number of the terminal. The electromagnetic valve includes a chamber formed inside thereof for allowing the movable member to cause a reciprocative movement, and this chamber is communicated with a fuel chamber provided in a fuel injection pump. The movable member is a circular plate-like armature normal to the axial direction of the valve member. The armature has a surface extending radially outward further than the through hole. The armature is cooperative with a cylindrical stator provided in the electromagnetic valve to form a magnetic circuit. The armature extends along a flat side surface of the cylindrical stator. The terminal is loosely inserted into the through hole. The through holes are positioned on the same radius of the movable member and symmetrically spaced with respect to a center of the movable member. The movable member is urged by auxiliary elastic means against the elastic means, and the auxiliary elastic means is weaker than the elastic means. When the solenoid is deactivated, the valve member is urged by the elastic member, thereby maintaining a constant clearance between the movable member and a stator provided in the electromagnetic valve. The clearance between the movable member and the stator is adjusted using a shim. The solenoid is constituted by a coil and a bobbin around which the coil is wound. An end of the coil is electrically connected to the terminal, and a molding member is provided to seal a connection between the coil and the terminal. The molding member serves to insulate the coil from a stator provided in the electromagnetic valve by keeping an appropriate clearance between the coil and the stator.

Furthermore, a second aspect of the present invention provides an electromagnetic valve for opening and closing a fuel return passage of a fuel injection pump, to control a time of fuel return when fuel compressed by a plunger of the fuel injection pump is overflowed from a high-pressure fuel chamber to a low-pressure fuel chamber, comprising: a valve member causing a reciprocative movement in an axial direction thereof to open or close the fuel return passage; a terminal supplying electric current to the electromagnetic valve, the terminal being disposed along the axial direction of the valve member; a plate-like movable member connected to one end of the valve member, the movable member having a through hole allowing the terminal to enter therein and causing a reciprocative movement together with the valve member; and a coil connected to the terminal, the coil being disposed in confronting relation to a side surface of the movable member located adjacent to the valve member.

With the arrangement of the present invention, the movable member (i.e. armature) is formed with at least one through hole into which the terminal is inserted. Thus, the radially outer periphery of the movable member can be extended radially outward further than the terminal. Thus, the area of the movable member is so increased that magnetic flux generated from a solenoid sufficiently passes through the movable member. Accordingly, a satisfactory magnetic attraction force is generated with few electric power supplied to the electromagnetic valve.

BRIEF DESCRIPTION OF THE DRAWINGS

The above and other objects, features and advantages of the present invention will become more apparent from the following detailed description which is to be read in conjunction with the accompanying drawings, in which.

DETAILED DESCRIPTION OF THE PREFERRED EMBODIMENT

A preferred embodiment of the electromagnetic valve in accordance with the present invention will be explained in greater detail hereinafter, with reference to the accompanying drawings.

One example of an electromagnetic valve of the present invention, employed in a fuel injection pump for a diesel engine, will be explained with reference to FIG. 3.

Figure 3:
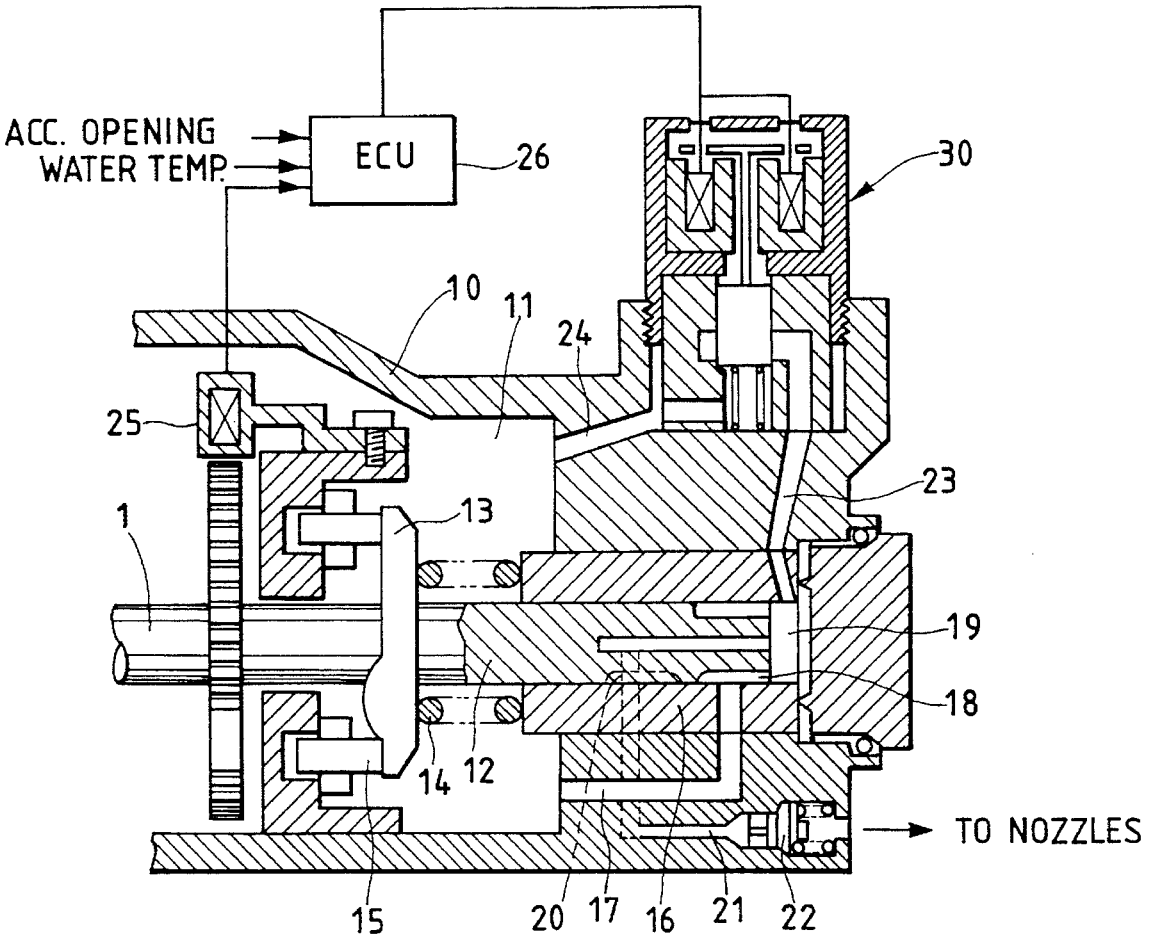
FIG. 3 is a cross-sectional view showing a fuel injection pump for a diesel engine employing the electromagnetic valve in accordance with the embodiment of the present invention.

In FIG. 3, a drive shaft 1 driven by an internal combustion engine (not shown) rotates a vane feed pump (not shown). The vane feed pump sucks up fuel from a fuel tank (not shown) and compresses, the fuel by vanes. A pressure of the compressed fuel is regulated at a predetermined value through a fuel pressure regulating valve. Thus regulated fuel is then introduced into a fuel chamber 11 formed in a pump housing 10. A force feed plunger 12, provided in the pump housing 10, is integral with the drive shaft 1 and therefore rotates in the same direction at the same speed as the drive shaft 1. The force feed plunger 12 is, however, slidable along the axis of the drive shaft so as to cause a reciprocative movement in the axial direction thereof. A face cam 13 is integrally provided with the force feed plunger 12. The face cam 13 is urged by a plunger spring 14, so that the face cam 13 can push cam rollers 15, - - - , 15. The combination of the cam rollers 15,- - - , 15 and the face cam 13 constitutes a well known mechanism of converting a rotational movement of the drive shaft 1 into a reciprocative movement of the force feed plunger 12. More specifically, a cam of the face cam 13 rides on the cam rollers 15, - - - ,15, so that the force feed plunger 12 integral with the face cam 13 can cause a reciprocative movement in synchronism with combustion of each cylinder in the internal combustion engine. The force feed plunger 12 defines a pump chamber 19 together with a head 16 fixed to the pump housing 10. The force feed plunger 12 is formed with suction grooves 18, - - - ,18 as many as the number of cylinders of the engine. One of these suction grooves 18, - - - , 18 is communicated with a fuel suction passage 17 in synchronism with a suction stroke of the force feed plunger 12, thereby introducing fuel from the fuel chamber 11 to the pump chamber 19. A distribution groove 20, formed in the force feed plunger 12, is communicated with a fuel distribution passage 21 during a force feed stroke of the force feed plunger 12. Thus, fuel is supplied from the pump chamber 19 to a fuel injection valve (not shown) of each cylinder through the distribution passage 21 and a force feed valve 22. Thereafter, fuel is injected in a combustion chamber of the internal combustion engine. Various operational information, such as an accelerator opening degree, an engine cooling water temperature, and a rotational angle of the drive shaft 1 detected by an angle sensor 25, are input into an ECU (i.e. engine control unit) 26. The ECU 26 processes these operational data and outputs an open/close control signal to an electromagnetic valve 30. Opening of the electromagnetic valve 30 is synchronized with the termination of force feed stroke. Thus, the fuel in the pump chamber 19 overflows or returns to the low-pressure fuel chamber 11 through overflow or return passages 23 and 24.

Figure 1:
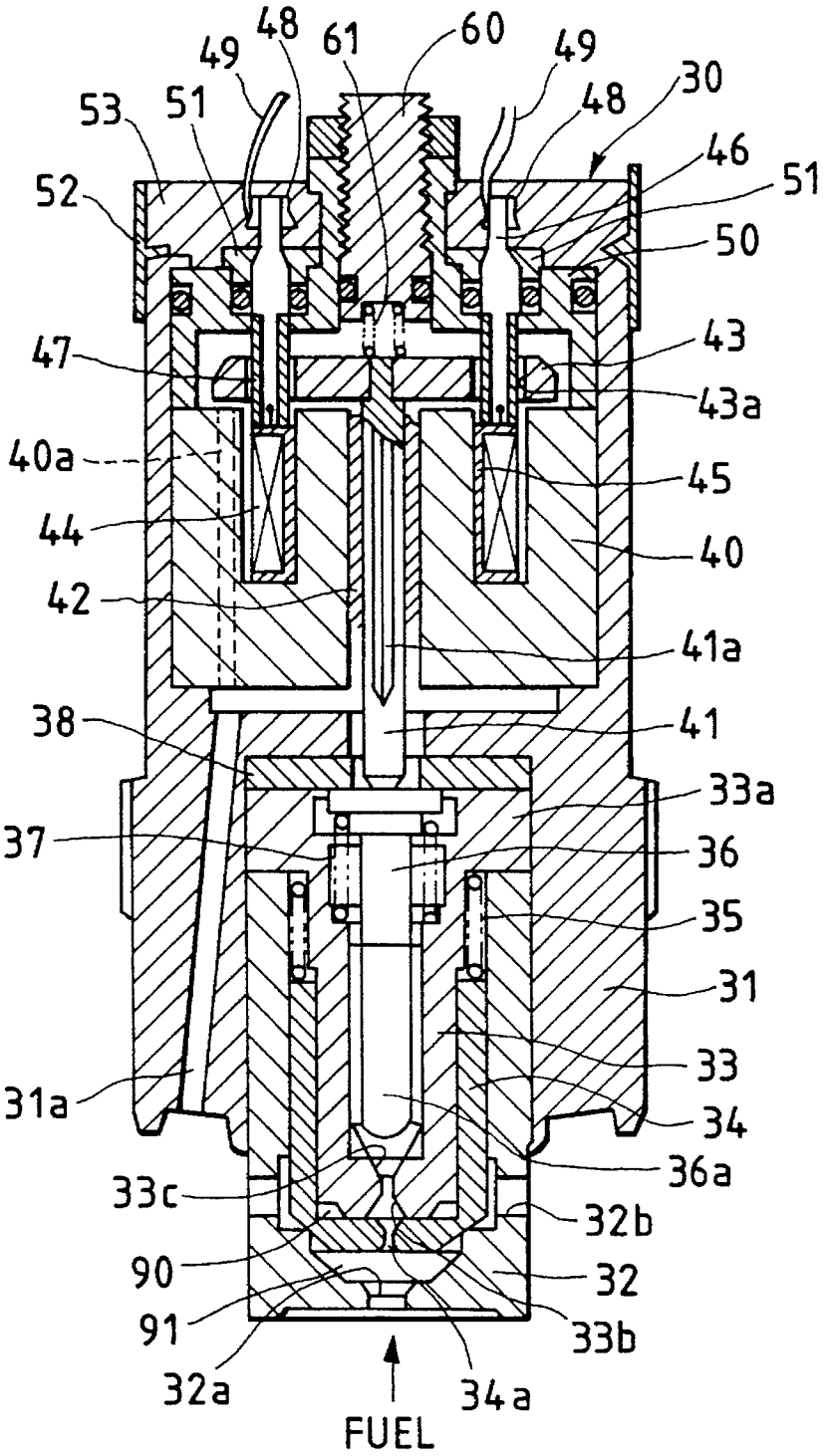
FIG. 1 is a cross-sectional view showing an electromagnetic valve in accordance with one embodiment of the present invention.
Figure 2:
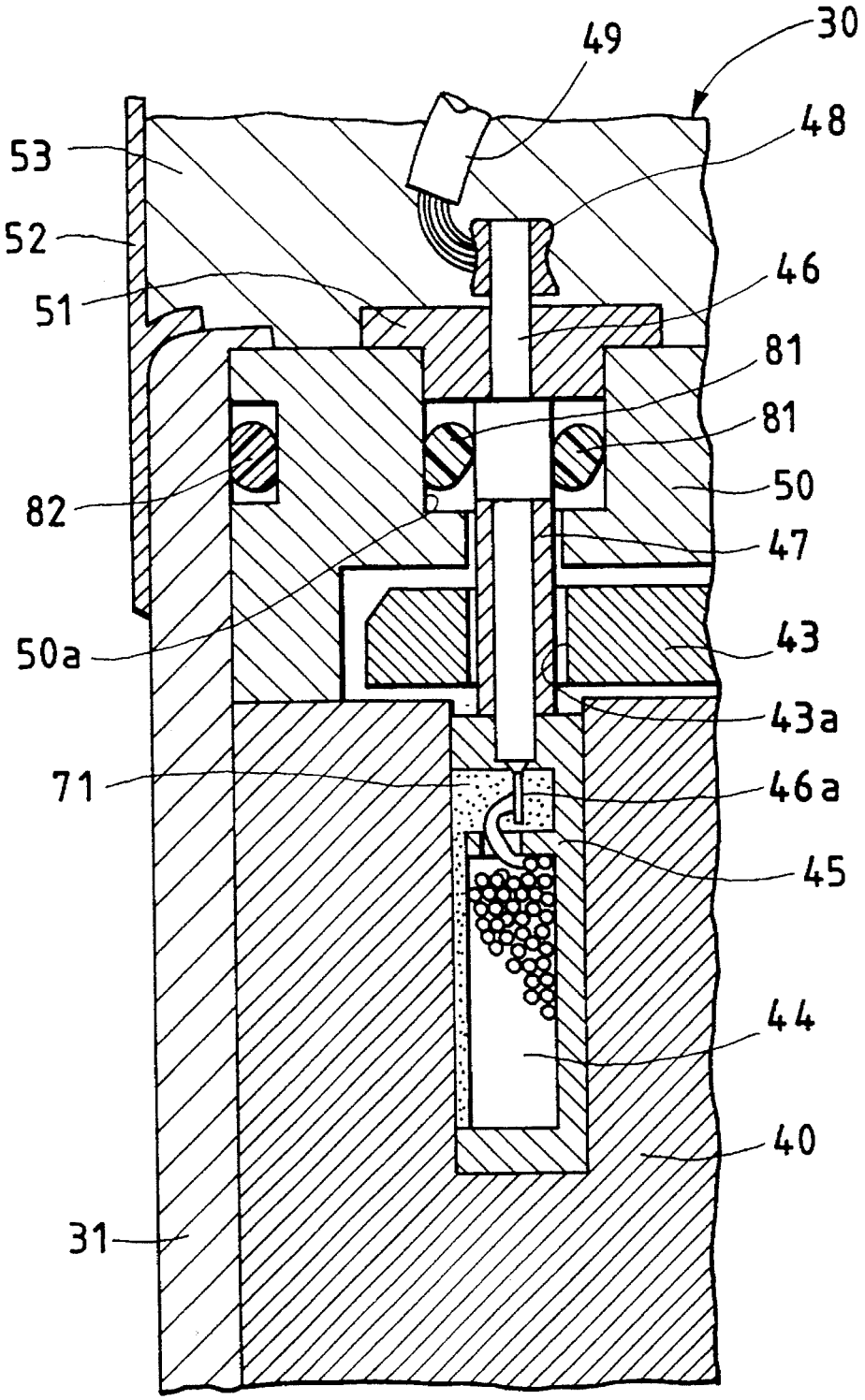
FIG. 2 is an enlarged cross-sectional view showing details of the vicinity of a terminal of the electromagnetic valve in accordance with the embodiment of the present invention.

A preferred embodiment of the electromagnetic valve in accordance with the present invention will be explained hereinafter with reference to FIGS. 1 and 2.

The electromagnetic valve 30 comprises a casing 31 made of non-magnetic substance with one end having a cylindrical bore therein. A valve body 32 is fixedly housed in the cylindrical bore of the casing 31. The valve body 32, having a fuel passage hole 32*a* formed at the bottom thereof, is communicated with the pump chamber 19. A stationary cylinder 33, having a fuel passage hole 33*b* formed at the bottom thereof, has a top end shaped into a flange 33*a* fixed to the cylindrical bore of the casing 31. A movable cylinder 34 is slidably supported on the inside wall of the valve body 32. A compression coil spring 35 urges the movable cylinder 34 so as to close the electromagnetic valve 30. The movable cylinder 34 has a fuel passage hole 34*a* formed on the bottom thereof. A valve needle 36 is slidably supported on the inside wall of the stationary cylinder 33, and a compression coil spring 37 gives the valve needle 36 a biasing force so as to open the electromagnetic valve 30. A shim 38 of disk-like shape is interposed between the casing 31 and the flange 33*a* of the stationary cylinder 33 along the axis of the electromagnetic valve 30. The shim 38 regulates the axial movement of the valve needle 36 to restrict the opening of the electromagnetic valve 30. The casing 31 has the other end having an inside bore in which a cylindrical stator 40 is fixedly accommodated. A bush 42 is secured on the inside cylindrical wall of the stator 40. A push rod 41 is surrounded by the bush 42, but the cylindrical bush 42 allows the push rod 41 to slide along the inside wall thereof. The push rod 41 is brought into contact with the valve needle 36 at one end thereof, and is connected to an armature 43 at the other end thereof.

Figure 4:
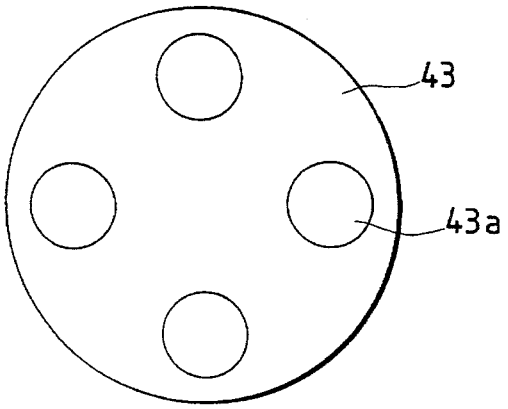
FIG. 4 is a plan view showing an armature of the electromagnetic valve in accordance with the embodiment of the present invention.
Figure 5:
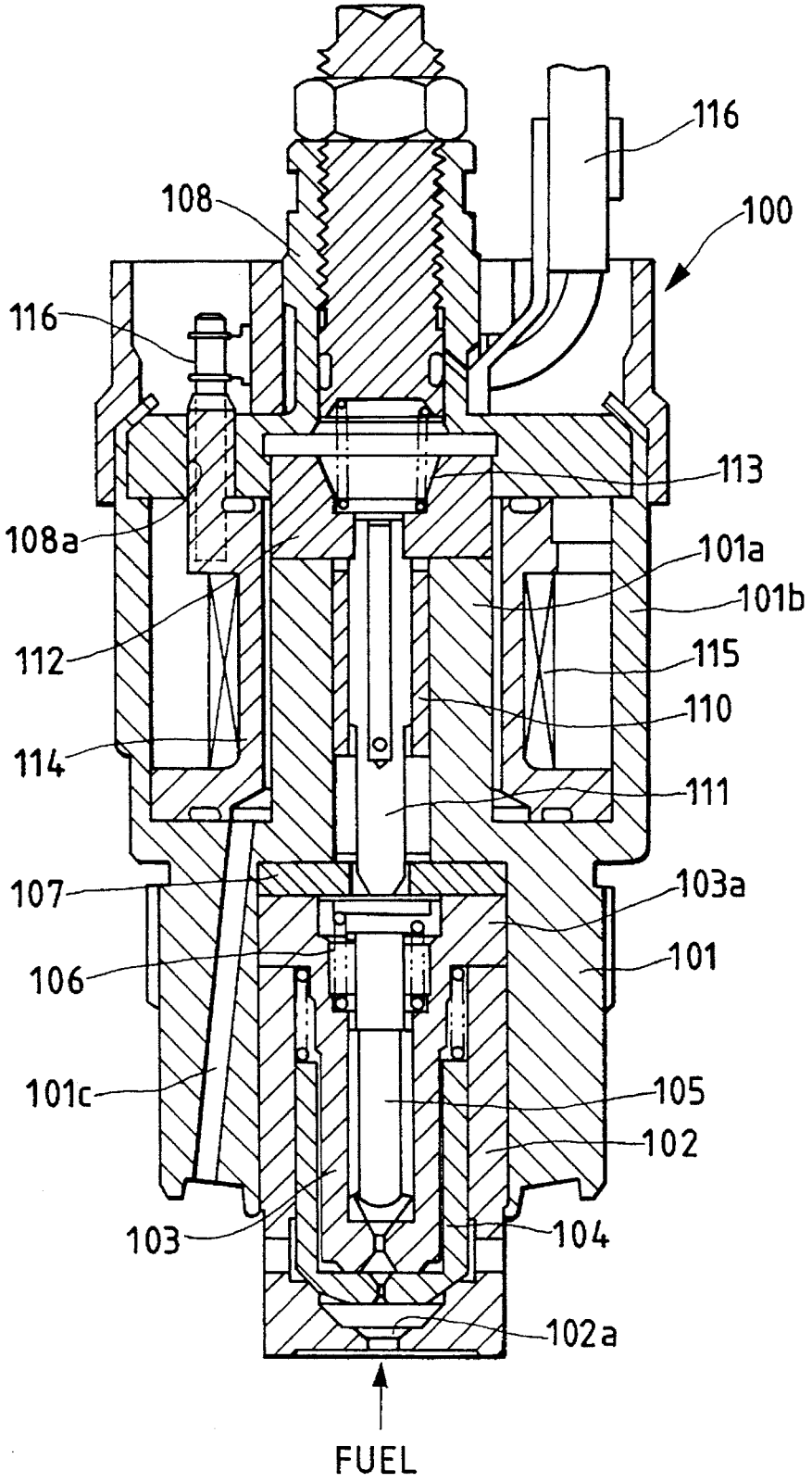
FIG. 5 PRIOR ART
FIG. 5 is a cross-sectional view showing a conventional valve.

The armature 43, made of magnetic substance, is formed into a circular plate configuration, i.e. a disk, extending normally to the axis of the electromagnetic valve 30 (or the valve needle 36) along the upper flat side surface of the stator 40. The armature 43 and the stator 40 are cooperative to form a magnetic circuit. The armature 43 has a plurality of through holes 43*a*, - - - , 43*a* of circular configuration whose centers are positioned on the same circumference or radius of the armature 43 and symmetrically spaced with respect to the center of the armature 43, as shown in FIG. 4. A terminal 46 later described is inserted into at least one of these through holes 43*a*, - - - , 43*a*. This embodiment shows a total of four through holes 43*a*, - - - , 43*a*, but the number of the through holes 43*a*, - - - , 43*a* can be varied or should be optimized considering easiness in the installation of the terminal 46, magnetic flux required for the magnetic circuit, and weight reduction of the armature 43. The number of the through holes 43*a*, - - - , 43*a* is larger than the number of the terminal(s) 46. With this arrangement, the outer periphery of the disk-like armature 43 can extend radially outward further than the through holes 43*a*, - - - , 43*a*. It is advantageous since the armature can have a wide surface but light weight. A compression coil spring 61 urges the armature 43 to close the electromagnetic valve 30. The biasing force of the compression coil spring 61 is smaller than that of the compression coil spring 37. Thus, when electric current supply to a coil 44 (i.e. solenoid) is stopped, the valve needle 36 is urged by the compression coil spring 37 to open the electromagnetic valve 30. Accordingly, the valve needle 36 abuts the shim 38, maintaining a constant clearance between the armature 43 and the stator 40, i.e. between the lower surface of the armature and the upper surface of the stator 40.

The coil 44 wound around a bobbin 45 is housed in a cylindrical groove formed in the stator 40. An end of the coil 44 is electrically connected to a flattened portion 46*a* of the terminal 46. A molding member 71 is a secondary molding applied to the coil 44. Thus, the molding member 71 allows the coil 44 to be coupled into the cylindrical groove formed in the stator 40, keeping an appropriate clearance between the coil 44 and the stator 40.

The terminal 46, entering into a through hole 43*a* formed on the armature 43, is further inserted into a terminal extraction hole 50*a* formed on a cover 50 made of non-magnetic substance. A cylindrical hollow insulating member 47, made of high anti-abrasion and non-magnetic material such as ceramic, surrounds the terminal 46 in the region from the through hole 43*a* to the terminal extraction hole 50*a*. The insulating member 47 is loosely coupled with the through hole 43*a* and the terminal extraction hole 50*a* so as to provide a clearance therebetween. Hence, the armature 43 can shift in up-and-down direction, i.e. in an axial direction of the electromagnetic valve 30, without interference with the terminal 46. A resin bush 51, forced into the terminal extraction hole 50*a*, fixes one end of the terminal 46 protruding out of the cover 50. Thus, by way of the terminal 46, the resin bush 51 pushes the bobbin 45 to the stator 40. The resin bush 51 also prevents an O-ring 81 from being lost out of the terminal extraction hole 50*a*. A wire clip 48, attached on the distal end of the terminal 46, electrically connects the wire 49 and the terminal 46. A cap 52 serves as an injection die for injecting potting resin 53. The O-ring 81 hermetically seals the clearance between the terminal 46 and the terminal extraction hole 50*a*. On the other hand, another O-ring 82 hermetically seals the clearance between the casing 31 and the cover 50.

Next, a manufacturing process of the vicinity of the terminal 46 will be explained chiefly with reference to FIG. 2.

The terminal 46 and the insulating member 47 are integrally formed together with the bobbin 45. The flattened portion 46*a* of the terminal 46 is electrically connected to the end of the coil 44 wound around the bobbin 45. For the secondary molding, both the coil 44 and the connection between the coil 44 and the flattened portion 46*a* of the terminal 46 are molded together by the molding member 71. A resultant assembly thus integrally molded is then inserted into the cylindrical groove of the stator 40. Subsequently, the terminal 46 is inserted into the through hole 43*a* of the armature 43, and continuously inserted into the terminal extraction hole 50*a* while the cover 50 is coupled from the top with the terminal 46. Then, the clearance between the casing 31 and the cover 50 is hermetically sealed by the O-ring 82. Meanwhile, the O-ring 81 is interposed between the terminal 46 and the terminal extraction hole 50*a* to hermetically seal the clearance therebetween. Next, the resin bush 51 is forced into the terminal extraction hole 50*a*. The wire clip 48 is attached on the distal end of the terminal 46, to electrically connect the wire 49 and the terminal 46. The cap 53 is coupled around the casing 31 for injecting the resin 54, thereby fixing the wire 49.

The coil 44 is supplied with electric current during a period from the beginning of the fuel intake stroke to the end of the fuel force feed stroke. When activated, the coil 44 generates magnetic flux which causes a magnetic attraction force moving the armature 43 against the biasing force of the compression coil spring, thereby closing the electromagnetic valve. The push rod 41 and the valve needle 36 are correspondingly urged in the same valve closing direction. Thus, the valve needle 36 is press fitted to the sheet 33*c* of the stationary cylinder 33.

When the fuel force feed stroke is terminated, electric current supply to the coil 44 is stopped. Hence, the armature 43 is not subjected to magnetic attraction force. Receiving only the biasing force from the compression coil spring 37, the valve needle 36 shifts to open the electromagnetic valve 30. Thus, fuel in the high-pressure pump chamber 19 is allowed to return to the low-pressure fuel chamber 11 via a total of two fuel return passages explained below. A first fuel return passage is defined by the fuel passage hole 32*a*, the fuel passage hole 34*a*, the fuel passage hole 33*b*, a slit 36*a*, and a fuel passage 31*a*. A second fuel return passage is defined by the fuel passage hole 32*a*, the fuel passage hole 34*a*, the fuel passage hole 33*b*, the slit 36*a*, a slit 41*a*, a fuel passage 40*a*, and the fuel passage 31*a*. As the fuel passage hole 33*b* has a transverse cross section larger than that of the fuel passage hole 34*a*, a fuel amount going out of the high-pressure chamber 90 is larger than a fuel amount entering into the high-pressure chamber 90. Thus, a pressure of the high-pressure chamber 91 become higher than that of the high-pressure chamber 90. This pressure difference causes the movable cylinder 34 to lift upward against the biasing force of the compression coil spring 35, allowing fuel in the high-pressure chamber 91 to overflow or return to the low-pressure fuel chamber 11 through a fuel passage hole 32*b*. By the way, the function of the fuel passage 40*a* is to introduce fuel from the low-pressure fuel chamber 11 of the fuel injection pump to a chamber accommodating the armature 43 therein to lubricate the armature 43 and the terminal 46.

According to the preferred embodiment of the present invention, a clearance between the stator 40 and the armature 43 is adjusted using the flat surface of the shim 38; thus, it is possible to assure a constant gap therebetween. Furthermore, as the terminal 46 is loosely inserted into the through hole 43*a* formed on the circular plate-like armature 43, the armature 43 can be freely extended radially outward without restriction or interference with the terminal 46 in the formation or installation of the armature 43. Thus, the armature 43 has a radially extending surface large in area. This is advantageous in that magnetic flux generated from the coil 44 and passing through the armature 43 is so increased that a magnetic attraction force obtained is twice as large as that of the conventional plunder type electromagnetic valve. Moreover, the arrangement of this preferred embodiment of the present invention allows to shorten the axial length of the armature 43. Thus, not only reduction of the axial length but reduction of size can be realized in the electromagnetic valve 30. Furthermore, adoption of the insulating member 47 having excellent anti-abrasion property for surrounding the terminal 46 is advantageous in that the armature 43 and the terminal 46 are surely insulated because the terminal 46 is certainly protected from being peeled off or torn out by repetitive reciprocative movements of the armature 43.

In short, the arrangement of the electromagnetic valve of the present invention gives a great degree of freedom in the layout of the armature (i.e. movable member). Thus, the surface of the armature serving to receive magnetic flux can be so increased that a sufficient magnetic attraction force acts on the armature even if electric current supplied to the coil is relatively small. Furthermore, the arrangement of the electromagnetic valve of the present invention provides a plurality of through holes which are effective to reduce the weight of the armature as well as avoiding the interference between the armature and the terminal. It is needless to say that weight reduction of the armature while maintaining a required amount of magnetic flux passing through the armature results in excellent response and high accuracy and reliability of the electromagnetic valve.

As this invention may be embodied in several forms without departing from the spirit of essential characteristics thereof, the present embodiment as described is therefore intended to be only illustrative and not restrictive, since the scope of the invention is defined by the appended claims rather than by the description preceding them, and all changes that fall within metes and bounds of the claims, or equivalents of such metes and bounds, are therefore intended to be embraced by the claims.

What is claimed is:

1. An electromagnetic valve comprising:

a valve member causing a reciprocative movement in an axial direction thereof;

elastic means for urging said valve member in one direction;

a plate-like movable member made of magnetic substance and including a plurality of through holes opened along the axial direction, said movable member being integral with said valve member and causing a reciprocative movement together with said valve member;

a solenoid generating magnetic field when activated, to attract said movable member against a biasing force of said elastic means; and a terminal supplying electric current to said solenoid, said terminal being inserted into the through hole of said movable member.

2. An electromagnetic valve in accordance with claim 1, wherein an insulating member is provided around said terminal at a region where said movable member causes a reciprocative movement, to insulate said terminal from the movable member.

3. An electromagnetic valve in accordance with claim 2, wherein said insulating member is made of anti-abrasion and non-magnetic material.

4. An electromagnetic valve in accordance with claim 1, wherein the number of said through holes formed on the movable member is larger than the number of the terminal.

5. An electromagnetic valve in accordance with claim 1, wherein said electromagnetic valve includes a chamber formed inside thereof for allowing said movable member to cause a reciprocative movement, and said chamber is communicated with a fuel chamber provided in a fuel injection pump.

6. An electromagnetic valve in accordance with claim 1, wherein said movable member is a circular plate-like armature normal to the axial direction of said valve member.

7. An electromagnetic valve in accordance with claim 6, wherein said armature has a surface extending radially outward further than said through hole.

8. An electromagnetic valve in accordance with claim 6, wherein said armature is cooperative with a cylindrical stator provided in said electromagnetic valve to form a magnetic circuit.

9. An electromagnetic valve in accordance with claim 8, wherein said armature extends along a flat side surface said cylindrical stator.

10. An electromagnetic valve in accordance with claim 1, wherein said terminal is loosely inserted into said through hole.

11. An electromagnetic valve in accordance with claim 1, wherein said through holes are positioned on the same radius of said movable member and symmetrically spaced with respect to a center of said movable member.

12. An electromagnetic valve in accordance with claim 1, wherein said movable member is urged by auxiliary elastic means against said elastic means, said auxiliary elastic means being weaker than said elastic means.

13. An electromagnetic valve in accordance with claim 12, wherein, when said solenoid is deactivated, said valve member is urged by said elastic member, thereby maintaining a constant clearance between said movable member and a stator provided in the electromagnetic valve.

14. An electromagnetic valve in accordance with claim 13, wherein, said clearance between the movable member and the stator is adjusted using a shim.

15. An electromagnetic valve in accordance with claim 1, wherein said solenoid is constituted by a coil and a bobbin around which said coil is wound.

16. An electromagnetic valve in accordance with claim 15, wherein an end of said coil is electrically connected to said terminal, and a molding member is provided to seal a connection between said coil and said terminal.

17. An electromagnetic valve in accordance with claim 16, wherein said molding member serves to insulate the coil from a stator provided in the electromagnetic valve by keeping an appropriate clearance between the coil and the stator.

18. An electromagnetic valve for opening and closing a fuel return passage of a fuel injection pump, to control a time of fuel return when fuel compressed by a plunger of the fuel injection pump is overflowed from a high-pressure fuel chamber to a low-pressure fuel chamber, comprising:

a valve member causing a reciprocative movement in an axial direction thereof to open or close said fuel return passage;

a terminal supplying electric current to said electromagnetic valve, said terminal being disposed along the axial direction of said valve member;

a plate-like movable member connected to one end of said valve member, said movable member having a through hole allowing said terminal to enter therein and causing a reciprocative movement together with said valve member; and a coil connected to said terminal, said coil being disposed in confronting relation to a side surface of said movable member located adjacent to the valve member.

19. An electromagnetic valve in accordance with claim 3, wherein said anti-abrasion and non-magnetic material is ceramic.

* * * * *